US006312094B1

(12) United States Patent
Ito et al.

(10) Patent No.: US 6,312,094 B1
(45) Date of Patent: Nov. 6, 2001

(54) INK-JET PRINTER

(75) Inventors: Takuro Ito; Norio Kouzu, both of Shizuoka-ken; Yasuhiro Suzuki, Numazu; Shinichiro Fujii, Mishima, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/123,193

(22) Filed: Jul. 27, 1998

(30) Foreign Application Priority Data

Jul. 30, 1997 (JP) ..... 9-204234
Sep. 19, 1997 (JP) ..... 9-255713
Mar. 18, 1998 (JP) ..... 10-068353

(51) Int. Cl.[7] ..... B41J 2/165
(52) U.S. Cl. ..... 347/36; 347/33; 347/22
(58) Field of Search ..... 347/104, 8, 33, 347/35, 36, 29, 30, 85

(56) References Cited

U.S. PATENT DOCUMENTS 5,266,975 * 11/1993 Mochizuki et al. ..... 347/36
5,517,222 * 5/1996 Sugiyama et al. ..... 347/35
5,555,461 * 9/1996 Ackerman ..... 347/33
5,997,128 * 12/1999 Lou et al. ..... 347/33
6,000,775 * 12/1999 Muraki ..... 347/8
6,050,683 * 4/2000 Nuita et al. ..... 347/104

FOREIGN PATENT DOCUMENTS 6-270420 9/1994 (JP) .

* cited by examiner

*Primary Examiner*—John Barlow
*Assistant Examiner*—An H. Do
(74) *Attorney, Agent, or Firm*—Frishauf, Holtz, Goodman, Langer & Chick, P.C.

(57) ABSTRACT

An ink-jet printer includes a rotary drum for holding a print medium, a print head for printing an image by ejecting ink onto the print medium held on the rotary drum, an ink receiving unit facing the print head at a non-printing time to receive ink ejected from the print head, and an ink collecting section for collecting ink from the ink receiving unit. Particularly, the ink collecting section includes a blade member for wiping out ink which is remaining on the ink receiving unit without being collected after ejection of ink.

19 Claims, 7 Drawing Sheets

INK-JET PRINTER

BACKGROUND OF THE INVENTION

The present invention relates to an ink-jet printer which prints an image onto a print medium held on a rotary drum with ink ejected from a print head, and more particularly, to an ink-jet printer whose print head is constituted by a plurality of ink-jet nozzles disposed in the axial direction of the rotary drum.

The popularity of serial-type ink-jet printers is spreading. In the serial-type ink-jet printer, a print head and an ink cassette of a relatively small capacity are integrally mounted on a carriage, and the carriage is movably attached to a guide bar extending across a paper sheet. The paper sheet is fed in a direction perpendicular to the guide bar at a constant pitch, and the carriage is moved along the-guide bar each time the paper sheet is fed for one pitch. The print head ejects ink during the movement of the carriage. In the case where the printer is used for color printing, the print head includes a plurality of ink-jet nozzles which are respectively supplied with inks of different colors from ink tanks. In the structure as described above, for example, a color image of A4 size is printed out in about ten minutes. Thus, the serial-type ink-jet printer operates at a slow print speed of 0.1 sheet per minute.

In recent years, a drum rotation type ink-jet printer has been developed to perform color printing at a higher speed. In this ink-jet printer, a paper sheet is held on a rotary drum rotating in one direction, and a print head includes a plurality of nozzle units which are arranged along the peripheral surface of the rotary drum and eject inks of different colors onto a paper sheet rotating together with the rotary drum. Each nozzle unit includes a plurality of ink-jet nozzles disposed across the paper sheet in the axial direction of the rotary drum. The pitch of the ink-jet nozzles is set to a value equal to a desired resolution or a value two to four times greater than the resolution. The print head is positioned such that the end surfaces of the ink-jet nozzles are close to the paper sheet on the rotary drum. The print head is set to a predetermined position in the case where the pitch of the ink-jet nozzles is equal to the desired resolution. The print head is set to be movable in the axial direction of the rotary drum from the predetermined position in the case where the pitch of the ink-jet nozzles exceeds the desired resolution. When the print head is movable in the axial direction of the rotary drum, the print head is moved at a rate corresponding to the desired resolution, for each revolution of the rotary drum, and is returned to the predetermined position after the print head is moved for a distance equal to the pitch of the ink-jet nozzles. The rotation speed of the rotary drum is set to 120 rpm. In this structure, for example, a color image of A4 size can be printed out in about two or three seconds. Also, since the print head is not moved by a distance exceeding the nozzle pitch in the axial direction of the rotary drum, the number of prints to be obtained for each ink charge can be increased by placing ink cassettes of a large-capacity at a position remote from the print head and supplying inks of different colors to the respective nozzle units of the print head.

In this ink-jet printer, maintenance is carried out to prevent clogging of the nozzles and to drive out bubbles by spitting ink from the ink-jet nozzles at the non-printing time. Further, if paper particles are scattered from a paper sheet rotating together with the rotary drum at a high speed and adhere to the end surfaces of the nozzles, the paper particles soak up ink supplied to the nozzles. In the case where several thousands of sheets are printed in one day, such paper particles containing ink will likely drop on a paper sheet and arise a serious problem of degrading the print quality. Therefore, ink is also used for cleaning which removes the paper particles from the end surfaces of the ink-jet nozzles at the non-printing time or at the time when printing is interrupted.

In the ink-jet printer, therefore, ink once used maintenance as described above must be collected as waste ink. When the ink-jet printer is made compact, it is, however, difficult securely collect waste ink without smudging the neighboring components equipped in the ink-jet printer.

BRIEF SUMMARY OF THE INVENTION

An object of the present invention is to provide an ink-jet printer capable of collecting waste ink easily and securely without smudging the neighboring components equipped therein.

According to the present invention, there is provided an ink-jet printer comprising: a rotary drum for holding a print medium; a print head for printing an image by ejecting ink onto the print medium held on the rotary drum; an ink receiving unit facing the print head at a non-printing time to receive ink ejected from the print head; and an ink collecting section for collecting ink from the ink receiving unit, wherein the ink collecting section includes a blade member for wiping out ink which is remaining on the ink receiving unit without being collected after ejection of ink.

In the ink-jet printer, the blade member is capable of efficiently remove ink ejected from the print head at the non-printing time and remaining on the ink receiving unit without being collected. Therefore, it is possible to prevent ink from splashing to neighboring components around the ink receiving unit when the ink receiving unit is moved aside in preparation for printing. That is, waste ink can be collected easily and securely without smudging the neighboring components.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

An ink-jet printer according to a first embodiment of the present invention will be explained with reference to FIGS. 1 to 7.

Figure 1:
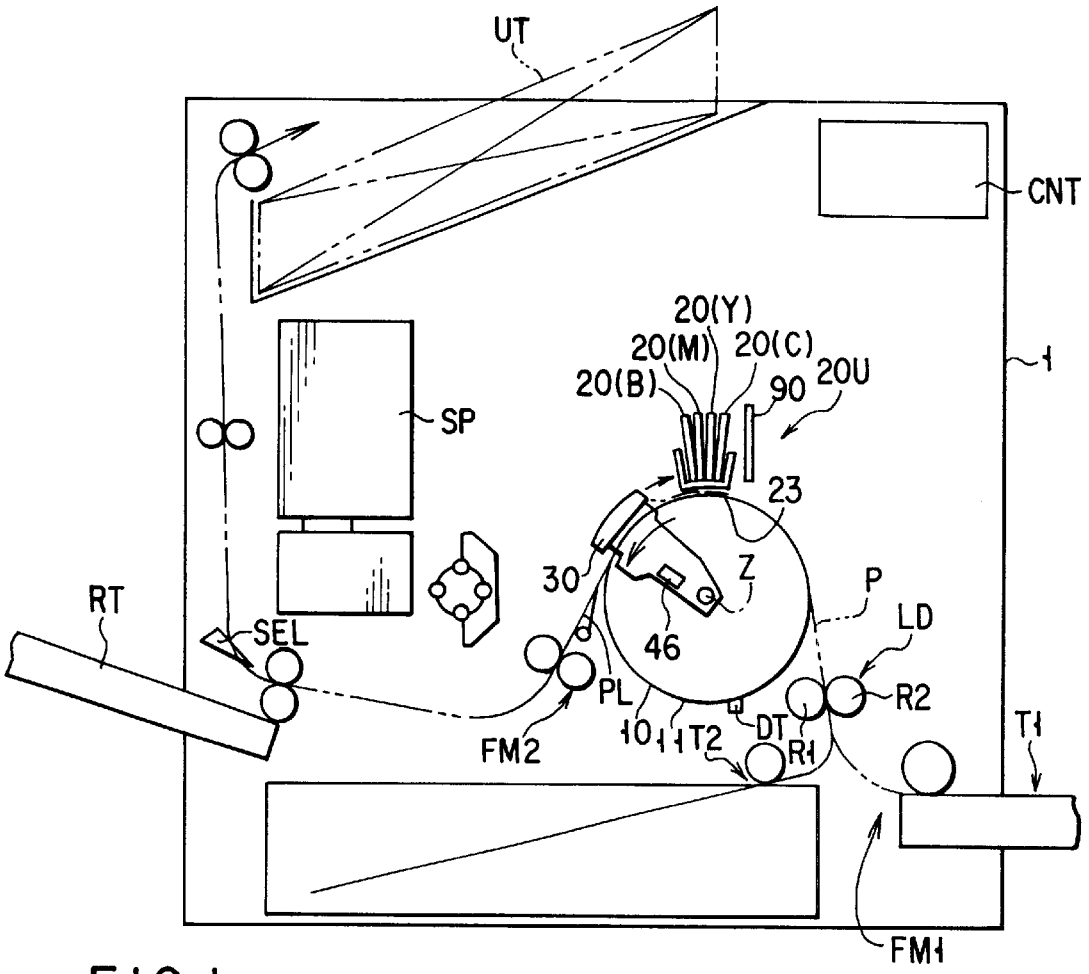
FIG. 1 is a view showing the internal structure of an ink-jet printer according to an embodiment of the present invention.

FIG. 1 shows an internal structure of the ink-jet printer. The ink-jet printer is used to print a multicolor image on a paper sheet P cut as a print medium. The paper sheet P may be a plain paper or OHP sheet.

The ink-jet printer includes a rotary drum 10 which holds a paper sheet P and rotates at a constant circumferential speed, a print head 20U for printing a multicolor image on the paper sheet P rotating along with the rotary drum 10, a manual feed tray T1 for a paper sheet P to be fed one by one, a paper cassette T2 for containing a stack of paper sheets P, a sheet feed-in mechanism FM1 for feeding a paper sheet P to the rotary drum 10 from the manual feed tray Ti and paper cassette T2, a sheet feed-out mechanism FM2 for feeding out the paper sheet P printed at the rotary drum 10, and a control unit CNT for controlling the overall operation of the ink-jet printer. As shown in FIG. 1, the rotary drum 10 is located near the central position within a housing 1. The manual feed tray T1 is located below the rotary drum 10 and projects externally from a front surface of the housing 1, and the paper cassette T2 is located under the rotary drum 10. The sheet feed-in mechanism FM1 is placed between the manual feed tray T1 and the paper cassette T2. The print head 20U is located above the rotary drum 10. The sheet feed-out mechanism FM2 is located behind the rotary drum 10.

Figure 2:
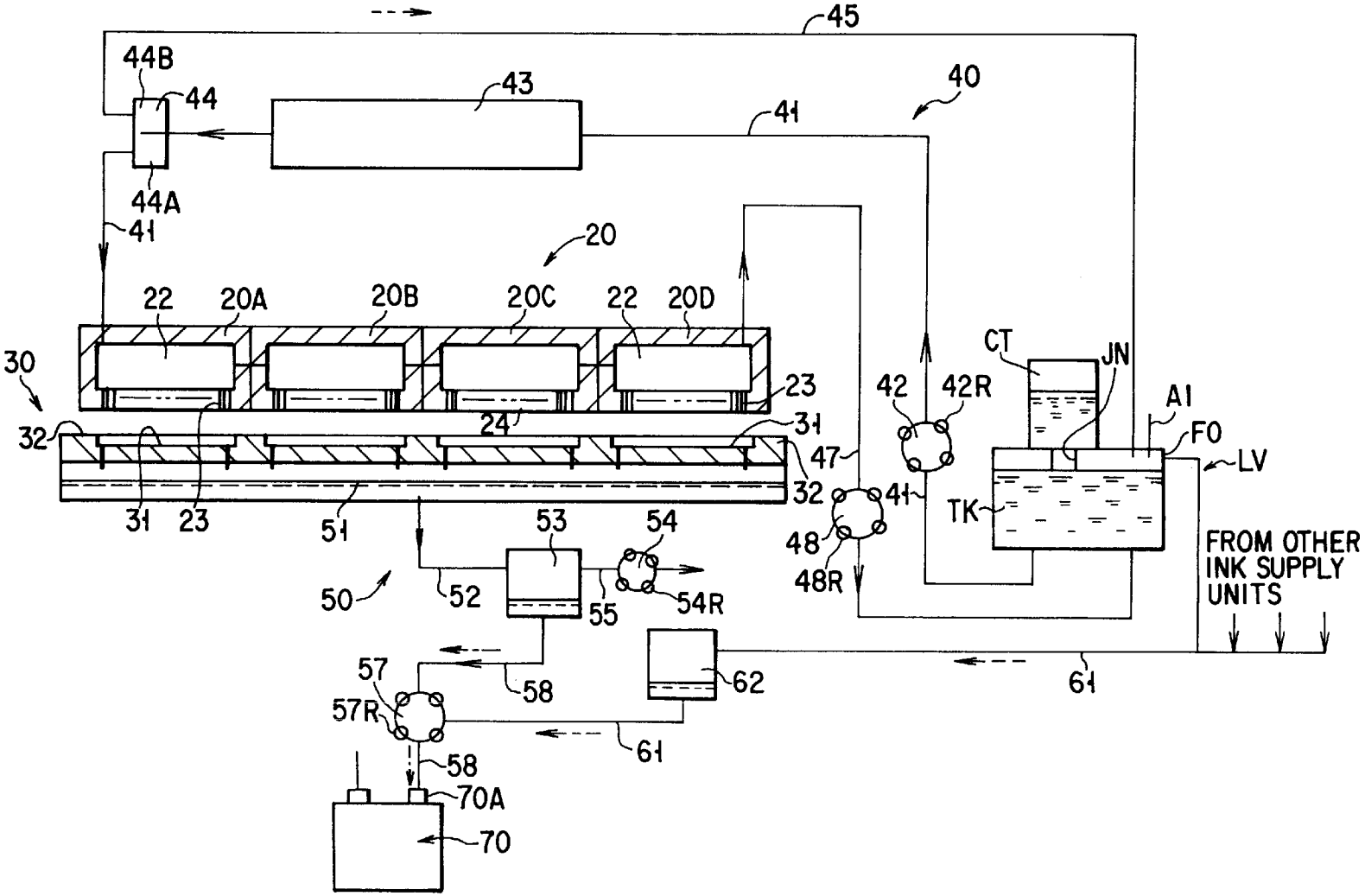
FIG. 2 is a view showing an ink treatment system of the ink-jet printer shown in FIG. 1.
Figure 5:
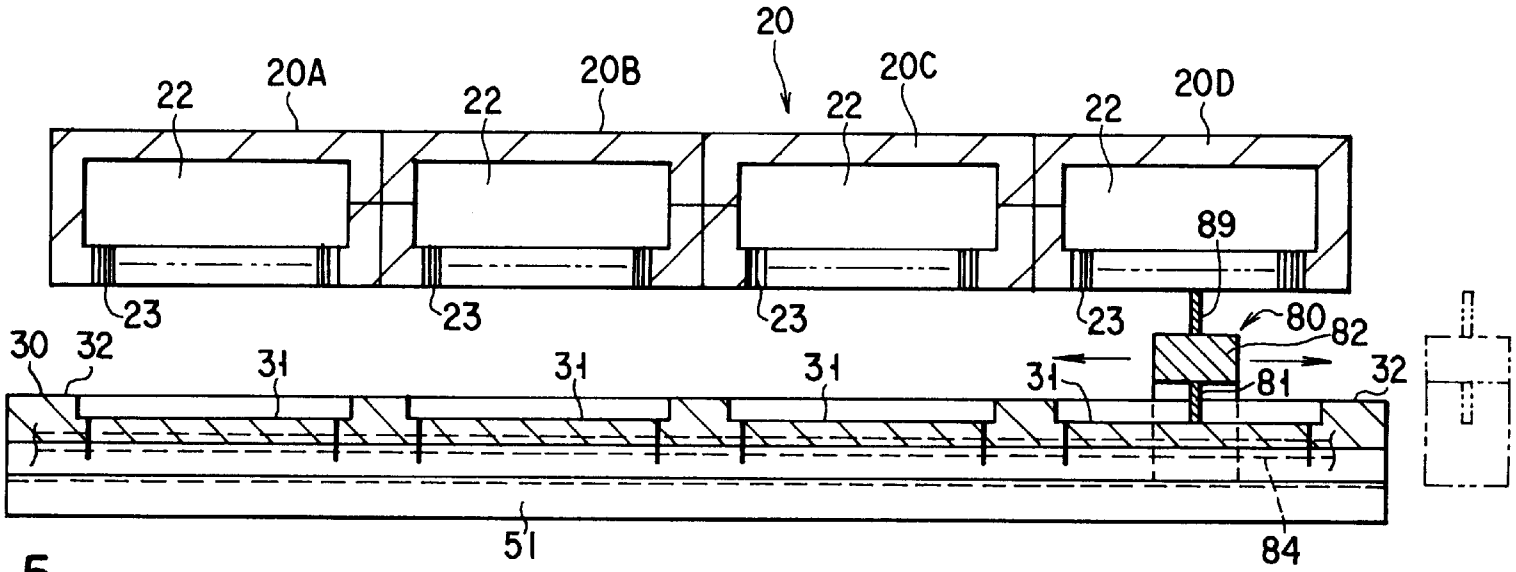
FIG. 5 is a view showing a positional relationship between the ink wiper section and each of a print head and the washing board shown in FIG. 4.
Figure 6:
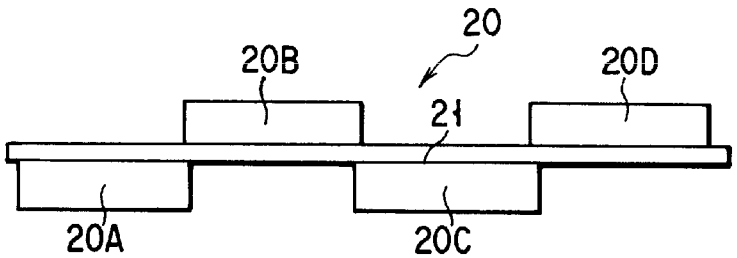
FIG. 6 is a view showing the placement of nozzle segments shown in FIGS. 2 and 5.

The rotary drum 10 is rotatably supported about the axis and holds the paper sheet P wound around a peripheral surface 11 thereof in accordance with its rotation. The rotational position of the rotary drum 10 is detected by a rotational position detector DT provided near the peripheral surface 11 of the rotary drum 10. The print head 20U includes nozzle units 20 (C, Y, M, B) which are arranged in series along the peripheral surface 11 of the rotary drum 10 from the upstream side to the down stream side so as to perform printing on the paper sheet P with inks of cyan (C), yellow (Y), magenta (M) and black (B). These nozzle units 20 (C, Y, M, B) are supplied with inks of the corresponding colors from an ink unit SP remote therefrom. Each of the nozzle units 20 (C, Y, M, B) has a plurality of ink-jet nozzles 23 which are arranged in the axial direction of the rotary drum 10 to have a span corresponding to the width of the paper sheet P of A4 size, and eject the corresponding color ink to the paper sheet P. More specifically, the nozzle units 20 (C, Y, M, B) are arranged to have the same structure, and each have a joint plate 21 and four nozzle segments 20A, 20B, 20C, and 20D as shown in FIGS. 2, 5, and 6. The joint plate 21 is set so as to extend in the axial direction X of the rotary drum 10 which coincides with the widthwise direction of the paper sheet P shown in FIG. 2. The nozzle segments 20A to 20D are provided in a zigzag arrangement on the joint plate 21, shifted from each other in the rotation direction R of the rotary drum 10. Specifically, the nozzle segments 20A and 20C are fixed to the front surface of the joint plate 21, whereas the nozzle segments 20B and 20D are fixed the rear surface of the joint plate 21. Pairs of adjacent nozzle segments 20A and 20B, 20B and 20C, and 20C and 20D are arranged so as to overlap each other slightly. The end surfaces of the ink-jet nozzles of the nozzle segments 20A to 20D are aligned to a height equal to the end surface 24 of the print head 20U. Each of the nozzle segments 20A to 20D is constituted by a predetermined number of ink-jet nozzles 23, and an ink chamber 22 for directly supplying ink to the ink-jet nozzles 23. The ink chambers 22 of the nozzle segments 20A to 20D are connected in series to flow ink therethrough. The pitch PT of the ink-jet nozzles 23 is set to 1/150 inch in the case where print resolution is 300 dpi in the main scanning direction X.

The sheet feed-in mechanism FM1 includes a paper loader LD for loading the paper sheet P to the rotary drum 10 such that the width direction of the paper sheet P coincides with the axial direction of the rotary drum 10, and feeds the paper sheet P taken out of either the manual feed tray T1 or the paper cassette T2. The paper loader LD is controlled to feed the paper sheet P toward the rotary drum 10 when the position detector DT detects that the rotary drum 10 has arrived at a predetermined rotational position. The print head 20U prints a multicolor image on the paper sheet P as the rotary drum 10 rotates.

The paper sheet P is separated from the peripheral surface 11 of the rotary drum 10 by a paper separation unit PL and fed in a predetermined direction by the sheet feed-out mechanism FM2. The paper separation unit PL is a separation claw which is brought into contact with the rotary drum 10 at the time of separating the paper sheet. A discharge switch SEL guides the paper sheet P to a selected one of a rear discharge tray RT with the print surface facing upward, and an upper discharge tray UT with the print surface facing downward.

The print head 20U can be slightly and reciprocally shifted in a main scanning direction X parallel to the axis of the rotary drum 10. The rotary drum 10 holds the paper sheet P wound around and held on the peripheral surface 11, and rotates to move the paper sheet P in a sub-scanning direction Y perpendicular to the main scanning direction X, with the paper sheet P opposing to the nozzle units 20C, 20Y, 20M, 20B. The rotary drum 10 is maintained to be a constant rotation rate of 120 rpm; that is, it is rotated at one revolution per 0.5 second. In a printing operation, the print head 20U is shifted in the main scanning direction X at a constant rate of ½ nozzle pitch PT every time the rotary drum makes one revolution, so that it moves by a distance equal to the nozzle pitch PT during two revolutions.

The paper loader LD includes at least a pair of feed rollers R1 and R2 extending in the axial direction of the drum 10 so as to load the paper sheet P supplied from the feeder T1 or T2 to the rotary drum 10 at a predetermined timing. The feed rate of the paper sheet P is set to the circumferential speed of the rotary drum 10. Since the diameter of the rotary drum 10 is 130 mm, a circumferential speed of 816 mm/sec can be obtained. The peripheral surface 11 of the rotary drum 10 is about 220 mm wide in the axial direction and 408 mm long in the rotational direction. Therefore, the rotary drum 10 can fully hold the A4 size paper sheet P having a length of 297 mm and a width of 210 mm.

The height of the print head 20U is automatically adjustable by a lift 90 shown in FIG. 1. At the printing time, the lift 90 sets the print head 20U to a lower limit position close to the rotary drum 10. At the non-printing time, the lift 90 sets the print head 20 to a upper limit position remote from the rotary drum 10, and then to a cleaning position determined between the upper limit position and the lower limit position.

The ink unit SP includes an ink supply unit 40 for each nozzle unit 20. The ink supply unit includes an ink tank TK which has a joint member JN for detachably supporting an ink cassette CT and stores ink supplied from the ink cassette CT, an ink supply tube 41 for guiding ink from the ink tank TK to the nozzle unit 20, and an ink return tube 47 for guiding ink from the nozzle unit 20 to the ink tank TK. The ink supply unit 40 further includes, a supply pump 42, an ink adjust section 43, a switch valve 44, a suction pomp 48, and a circulation tube 45. The supply pump 42, the ink adjust section 43, and the switch valve 44 is interposed in the ink supply tube 41. The suction pump 48 is interposed in the ink return tube 47. The supply pump 42 suctions ink from the ink tank TK to flow it along the ink supply tube 41. The ink adjust section 43 includes a filter for cleaning ink supplied from the supply pomp 42 toward the switch valve 44, and a heater for heating the ink. The switch valve 44 has a first port 44A connected to the ink supply tube 41 for guiding ink to the nozzle unit 20 and a second port 44B connected to the circulation tube 45 for guiding ink to the ink tank TK, and is arranged to select one of the ports 44A and 44B. The first port 44A is selected when ink is ejected from the nozzle unit 20, and the second port 44B is selected when ink is returned to the ink tank TK for initial temperature adjustment. The suction pump 48 suctions excessive ink not ejected and remaining in the nozzle unit 20 to return it to the ink tank along the ink return tube 47. The ink tank TK has a liquid surface stabilizer LV for maintaining the ink liquid surface at a predetermined height. The liquid surface stabilizer LV is constituted by an air intake AI for ventilating the ink tank TK with the atmospheric air, and an overflow port FO opened at an upper portion of the side wall of the ink tank TK. When ink is supplied from the ink cassette CT and the ink liquid surface exceeds the predetermined height, ink is drained from the overflow port FO until the ink liquid surface falls below the predetermined height. Thus, a distance between the ink liquid surface in the ink tank TK and the nozzle unit 20 is restricted in the vertical direction to fall within a predetermined range.

The control unit CNT of the ink-jet printer is arranged to perform a maintenance process for driving out bubbles and preventing clogging of the ink-jet nozzles 23 by forcibly ejecting ink from the nozzles 23. In the maintenance process, ejected ink is further used to remove paper particles adhered to the end surface 24 of the print head 20U constituted by end surfaces of the ink-jet nozzles 23. Further, a washing board 30 is interposed between the rotary drum 10 and the print head 20U by a rotation mechanism 46 so as to face the print head 20U in the maintenance process. The print head 20U is moved up to the upper limit position so as not to disturb the movement of the washing board 30 and moved down to the cleaning position after the movement of the washing board 30.

Figure 3:
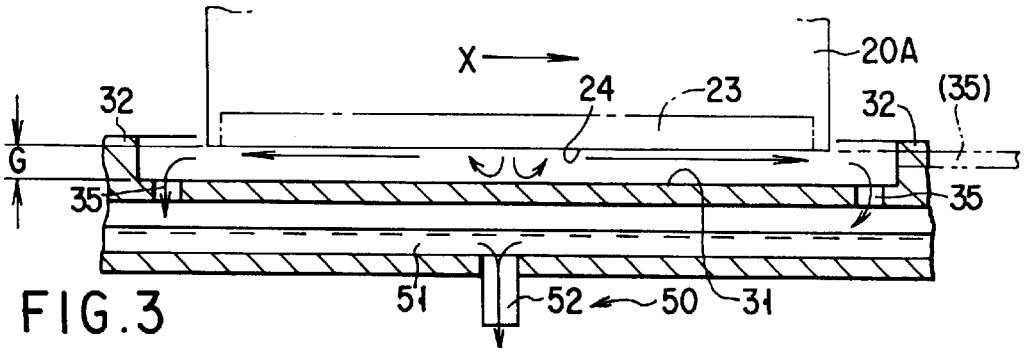
FIG. 3 is a view showing the cross-sectional structure of the washing board shown in FIG. 1.
Figure 4:
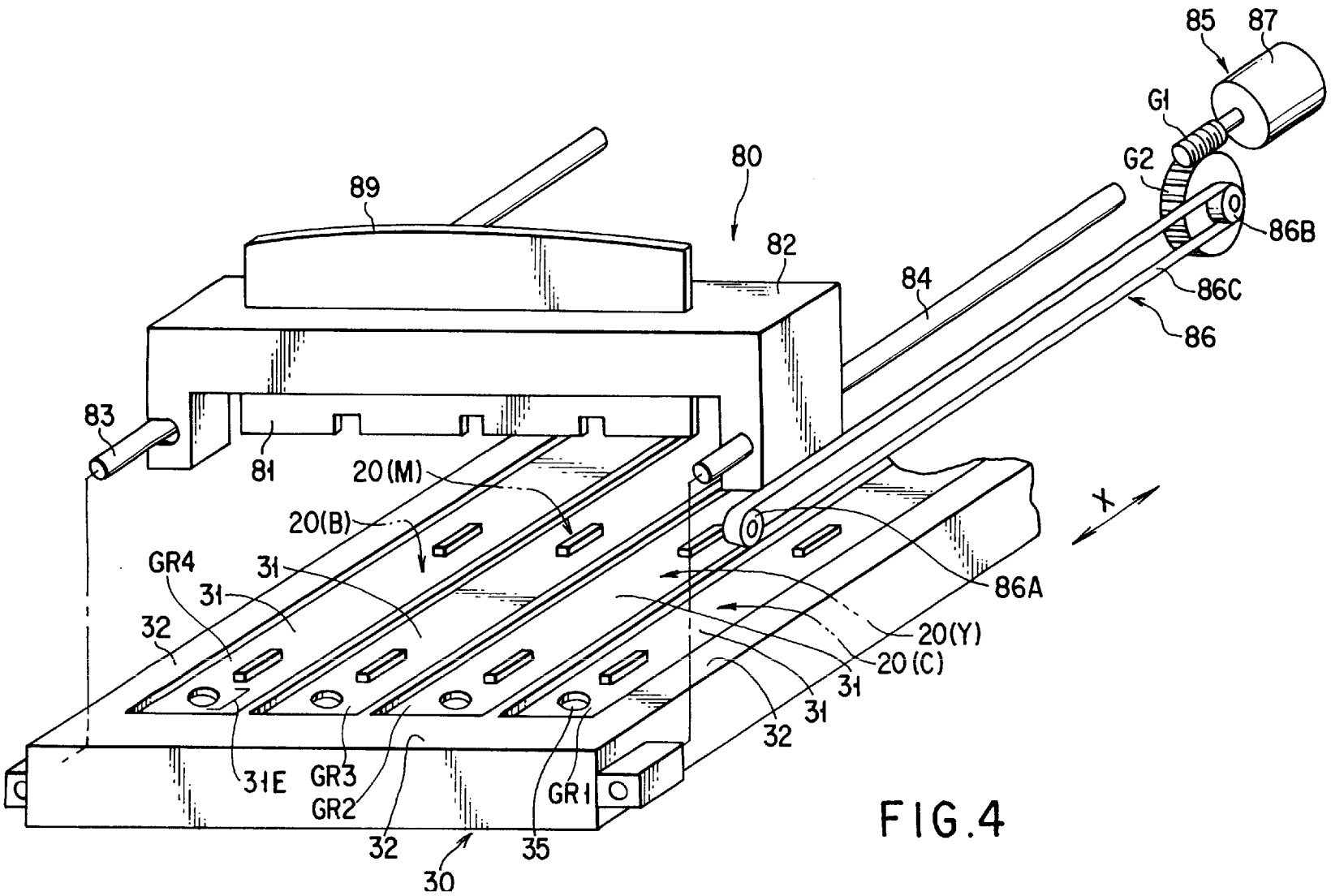
FIG. 4 is a perspective view of an ink wiper section attached to the washing board shown in FIG. 3.

The washing board 30 is formed to be used in common by the four nozzle units 20 (C, Y, M, B), as shown in FIG. 4. That is, the washing board 30 includes four lines of grooves GR1 to GR4 for the nozzle units 20 (C, Y, M, B). The grooves GR1 to GR4 extend in the axial direction of the rotary drum 10 along lines of the ink-jet nozzles 23, and partitioned by ink stopper walls 32. These grooves GR1 to GR4 are respectively associated with the nozzle units 20 (C, Y, M, B) to create four ink flow generation chambers. The ink flow generation chambers are defined as spaces surrounded by ink reception plates 31 serving as the bottoms of the grooves GR1 to GR4, the end surfaces 24 of the nozzle units 20 (C, Y, M, B), and the ink stopper walls 32. Each ink reception plate 31 has a pair of drain holes 35 formed in non-opposed areas 31E located on the both sides of the end surface 24 in the axial direction X of the rotary drum 10 and not opposed to the end surface 24 as shown in FIGS. 3 and 4. An ink collection chamber 51 shown in FIGS. 2 and 3 is connected through the drain holes 35 to the ink flow generation chambers so as to commonly drain inks ejected from the nozzle units 20 (C, Y, M, B).

The washing board 30 further includes a plurality of projections projected from the ink reception plates 31 and serving as a position determination member 34 for determining a gap G between the end surfaces 24 and the ink reception plates 31. The lift 90 stops elevating down the print head 20U when the lower surface of the joint plate 21 is brought into contact with the upper surface of the position determination member 34.

The gap G is selected to a value within a range of 0.1 to 0.5 mm, and preferably at a value of 0.3 mm.

The ink-jet printer further includes an ink drain section 50 for draining ink stored in the ink collection chamber 51 and ink overflowed from the ink tank TK as waste ink. The ink drain section 50 includes a drain tube 52, a gas and liquid separation tank 53, a suction pump 54, a drain tube 55, a drain pump 57, and a waste ink tube 58, an overflow tube 61, an overflow tank 62, and a waste ink cassette 70. The ink collection chamber 51 is connected to the gas and liquid separation tank 53 by the drain tube 52. The gas and liquid separation tank 53 is connected to the suction pump 54 by the drain tube 55, and to the drain pump 57 by the waste ink tube 58. The overflow port FO of the ink tank TK is connected to the overflow tank 62, and the overflow tank 62 is connected to the drain pump 57 by the overflow tube 61. The drain pump 57 is connected to the waste ink cassette 70 by the waste ink tube 58. Ink in the ink collection chamber 51 is suctioned by a suction force of the suction pump 54 and drained into the separation tank 53, and then to the waste ink cassette 70 by a suction force of the drain pump 57. Further, ink overflowed from the ink tank TK and temporarily stored in the overflow tank 62 is drained into the waste ink cassette 70 by a suction force of the drain pump 57. The waste ink cassette 70 is made to be detachable so as to periodically dispose of the waste ink.

In addition, the ink supply tube 41, the ink return tube 47, the drain tube 55, the waste ink tube 58, the overflow tube 61 are elastic tubes made of synthetic resin and having excellent flexibility. The supply pump 42, the suction pump 48, the suction pump 54, and the drain pump 57 are of a rotary type having four pressure rollers 42R, 48R, 54R, and 57R provided at a predetermined interval on a circular locus. A flow of ink is generated in a state where the four pressure rollers 42R, 48R, 54R, or 57R of each pump rotate while pressing the elastic tube. This flow of ink is stopped by terminating the rotation of the four pressure rollers 42R, 48R, 54R, or 57R. Each of the pumps 42, 48, 54, and 58 has a valve function of setting the elastic tube into a closed state by terminating the rotation of the four pressure rollers 42R, 48R, 54R, or 57R and into an open state by rotating the four pressure rollers 42R, 48R, 54R, or 57R. The supply pump 42 and the suction pump 48 are simultaneously driven to circulate ink between the ink tank TK and the nozzle unit 20 at the time of ejecting ink from the nozzle unit 20. The suction pump 54 is driven in a state where the drain pump 57 is not driven, so as to effectively suction ink from the ink collection chamber 51 to the gas and liquid separation tank 53. The drain pump 57 is driven after ink has been suctioned by the suction pump 54.

Figure 7:
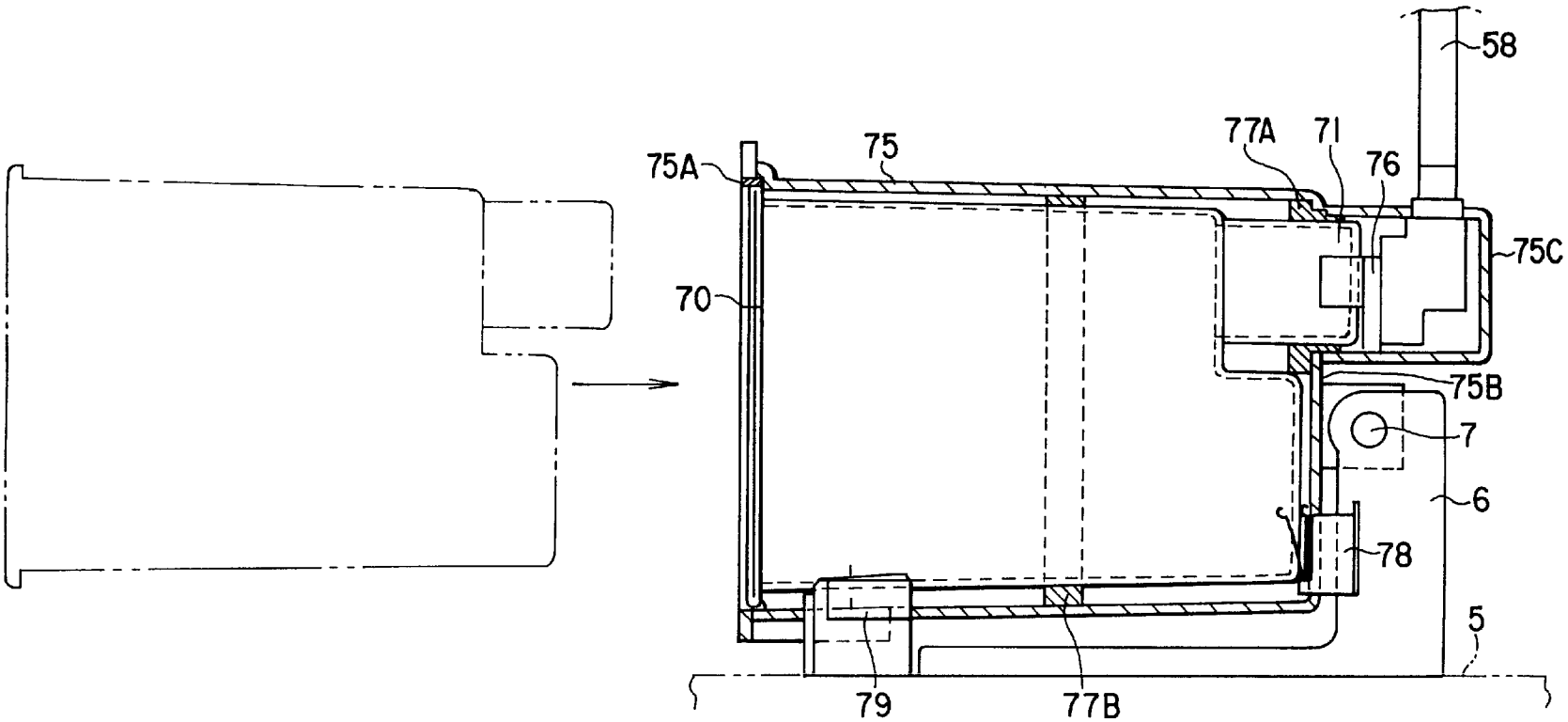
FIG. 7 is a view showing the structure of a waste ink cassette holder which holds a waste ink cassette shown in FIG. 2.

The waste ink cassette 70 contains a soak member (such as a sponge or the like) having an excellent ink soaking property, and collects waste ink by causing the ink to be soaked by the soak member. The waste ink cassette 70 is detachably attached to the waste ink cassette holder 75, as shown in FIG. 7. The waste ink cassette holder 75 includes a side portion 75B which is rotatably coupled via a hinge portion 7 to a support member 6 on the side of the printer body 5, and receives the waste ink cassette 70 inside of an opening portion 75A as shown in FIG. 7.

The waste ink cassette holder 75 further includes a sub-chamber 75C extending from the side portion 75B thereof, and a connection portion 76 connected to the waste ink tube 58 and disposed in the sub-chamber 75C. The connection portion 76 is connectable to a connection portion of the waste ink cassette 70 at the time of attaching the waste ink cassette 70. In the vicinity of the waste ink cassette holder 75, an ink soak pad 77A, an ink cassette sensor 78, and an ink full detection sensor 79 are provided.

The ink soak pad 77A is disposed between the connection portion 71 of the waste ink cassette 70 and the waste ink cassette holder 75 so as to soak ink leaked when the waste ink cassette 70 is attached to and detached from the waste ink cassette holder 75. The waste ink cassette 70 is provided with a valve (not shown) for closing the connection portion 71 upon motion of detaching the waste ink cassette 70 so as to keep the waste ink therein. The ink cassette sensor 78 is mounted on the support member 76 to detect whether or not a waste ink cassette 70 is attached to the waste ink cassette holder 75. The ink full detection sensor 79 is mounted on the support member 6 whether or not the waste ink cassette 70 is full of ink. The drain pump 57 is driven to rotate on condition that attachment of the waste ink cassette 70 is detected by the ink cassette sensor 78. If it is detected by the waste ink full detection sensor 79 that the waste ink cassette 70 is full of ink, driving of the drain pump 57 is stopped and a notification of the full of waste ink is presented to a user by a display (not shown). As shown in FIG. 7, an ink soak pad 77B is also disposed in the waste ink cassette holder 75 between the connection portion 71 of the waste ink cassette 70 and the ink full detection sensor 79, so as to prevent the performance of the waste ink full detection sensor 79 from being degraded due to contamination thereof.

When the waste ink cassette 70 is attached to the waste ink cassette holder 75 and the connection portion 76 on the side of the ink tube 58 is connected to the connection portion 71 of the waste ink cassette 70, attachment of the waste ink cassette 70 is detected by the ink cassette sensor 78. Upon detection of the attachment, the drain pump 57 is driven to drain waste ink from the gas and liquid separation tank 53 and the overflow tank 62 into the waste ink cassette 70.

As shown in FIG. 4, the ink-jet printer further includes an ink wiper section 80 which is mounted on the washing board 30 and wipes out ink remaining on the ink reception plates 31 of the washing board 30 after cleaning the print head 20U. In this embodiment, the ink wiper section 80 is also used to wipe out ink remaining on the end surface of the print head 20U. The ink wiper section 80 includes a first blade 81, a second blade 89, a blade support member 82, a pair of guide rods 83 and 84, and a blade drive section 85. The guide rods 83 and 84 are disposed at the side ends of the washing board 30 and extend in the axial direction X of the rotary drum 10. The blade support member 82 is slidably supported by the guide rods 83 and 84. The first blade 81 is made of an elastic thin plate which extends from the bottom surface of the blade support member 82 to contact the ink reception plates 31 of the washing board 30. The second blade 89 is made of an elastic thin plate extending from the top surface of the blade support member 82 to contact the end surface 24 of the print head 20. The blade drive section 85 includes a support member moving mechanism 86 for reciprocating the blade support member 82 along the guide rods 83 and 84 and a drive motor 87 for driving the support member moving mechanism 86. The support member moving mechanism 86 has a pair of pulleys 86A and 86B disposed near the both ends of the guide rod 84, and an endless belt 86C bridged over the pulleys 86A and 86B and partially connected to the blade support member 82. The pulley 86B is connected to the drive motor 87 via a series of worm wheel gears G1 and G2. With this structure, the blade support member 82 reciprocates in the axial direction of the rotary drum 10 upon rotation of the drive motor 87. At this time, the first blade 81 slides in contact with the ink reception plates 31 of the washing board 30 to wipe out ink and paper particles remaining on the ink reception plates 31.

The second blade 89 slides in contact with the end surface 24 of the print head 20U to wipe out ink remaining on the end surface 24.

As described above, the ink-jet printer performs a maintenance process of ejecting ink at the non-printing time to prevent clogging of the nozzles 23 and drive out bubbles. In the maintenance process, the washing board 30 is interposed between the print head 20U and the rotary drum 10 so as to face the print head 20U, and the supply pump 42 and the suction pump 48 are simultaneously driven to increase the ink pressure of the ink chambers 22 and forcibly eject ink from all the ink-jet nozzles 23 of the nozzle units 20 (C, Y, M, B). As a result, paper particles adhered to the end surfaces 24 of the nozzle units 20 (C, Y, M, B) are removed by a flow of ink generated in the space defined by the end surfaces 24 and the grooves GR1 to GR4 of the washing board 30, while preventing clogging and driving bubbles.

The ink drain section 50 is driven during or after the ejection of ink to drain ink stored in the ink collection chamber 51 via the drain holes 35 of the ink reception plates as waste ink. The waste ink is fed together with air gas from the ink collection chamber 51 to the gas and liquid separation tank 53 by driving the suction pump 54, and separated from the gas in the separation tank 53. That is, the waste ink is collected at the bottom portion of the separation tank 53, and the air gas is collected at the upper portion of the separation tank 53. Further, the air gas is fed to the atmosphere via the drain tube 55 by the suction pump 54. The drain pump 57 is driven after driving of the suction pump 54. At this time, the waste ink is suctioned through the waste ink tube 58 and drained into the waste ink cassette 70.

According to the embodiment, the first blade 81 of the ink wiper section 80 wipes out ink and paper particles remaining on the ink reception plates 31 of the washing board 30 after cleaning of the print head 20U. Thus, ink can be prevented from being scattered from the ink reception plates 31 when the washing board 30 is moved from the cleaning position in preparation for printing. Further, the second blade 89 is driven along with the first blade 81. Thus, ink remaining on the end surface 24 of the print head 20U can be efficiently and securely removed.

The ink drain section 50 drains waste ink from the washing board 30 to the detachable waste ink cassette 70. Thus, it is possible to lengthen the interval for disposing of the waste ink. The waste ink cassette 70 can securely collect a remarkable amount of waste ink without leaking the waste ink, since cassette 70 retains the waste ink soaked by the ink soak member. Since the paper sheet P and the inside of the housing 1 can be completely prevented from being smudged or contaminated with ink, a manual cleaning work for the contamination can be omitted. Further, this moderates restriction in the inner design layout of the printer, so that the size, weight, and costs of the printer can be much more improved.

The ink drain section 50 also drains ink overflowed from the ink tank TK to the waste ink tank TK. Therefore, supply of ink can be stabilized.

Since the drain pump 57 is not driven during suction of ink made by the suction pump 54, waste ink can be efficiently suctioned from the ink collection chamber 51.

The waste ink cassette 70 is detachably attached to the waste ink cassette holder 75. Upon attachment of the cassette 70, the cassette 70 and the waste ink tube 58 are connected to each other through the connection portions 71 and 76. Therefore, attachment and detachment of the waste ink cassette 70 can be carried out more easily and securely.

In addition, since the waste ink cassette holder 75 can be rotated around a hinge portion 7 as a center, the orientation of the opening portion 75A can be freely changed for attachment of the waste ink cassette 70. Accordingly, handling of the cassette 70 can be simplified.

The liquid surface stabilizer section LV makes the ink in the ink tank TK overflow to maintain constant ink liquid surfaces. The horizontal plane area of the ink tank TK needs not be increased to restrict change in the level of the ink liquid surface, but downsizing can be achieved in compliance with the installation space. Further, change of the ink pressure acting on the ends of the nozzles from the ink tanks TK through the ink supply tubes 41 are restricted, so that the shapes and sizes of ink drops ejected from the ends of the nozzles 23 can be made uniform and high quality printing can be achieved.

Each of the pumps 42, 48, 54, and 58 has a valve function of setting the elastic tube into a closed state by terminating the rotation of the pressure rollers and into an open state by rotating the pressure rollers. Therefore, switching between the states can be effected quickly, and the amount of ink flow can be controlled with accuracy. Moreover, since the pumps 42, 48, 54, and 58 has the same structure and the elastic tube has flexibility, it is possible to reduce the time required for fabricating the ink-jet printer and the manufacturing cost.

Figure 8:
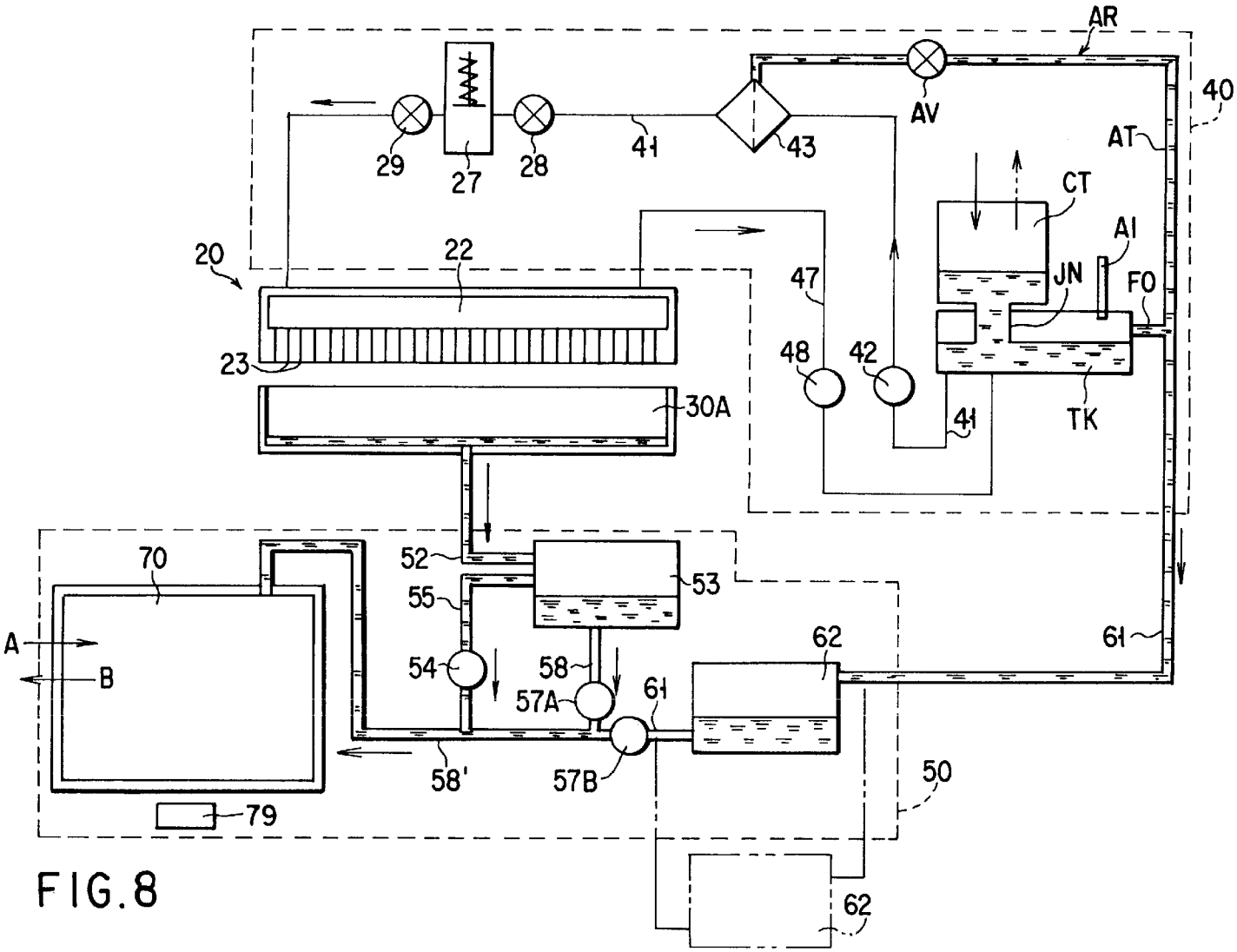
FIG. 8 is a view for explaining a modification of the ink treatment system shown in FIG. 2.
Figure 9:
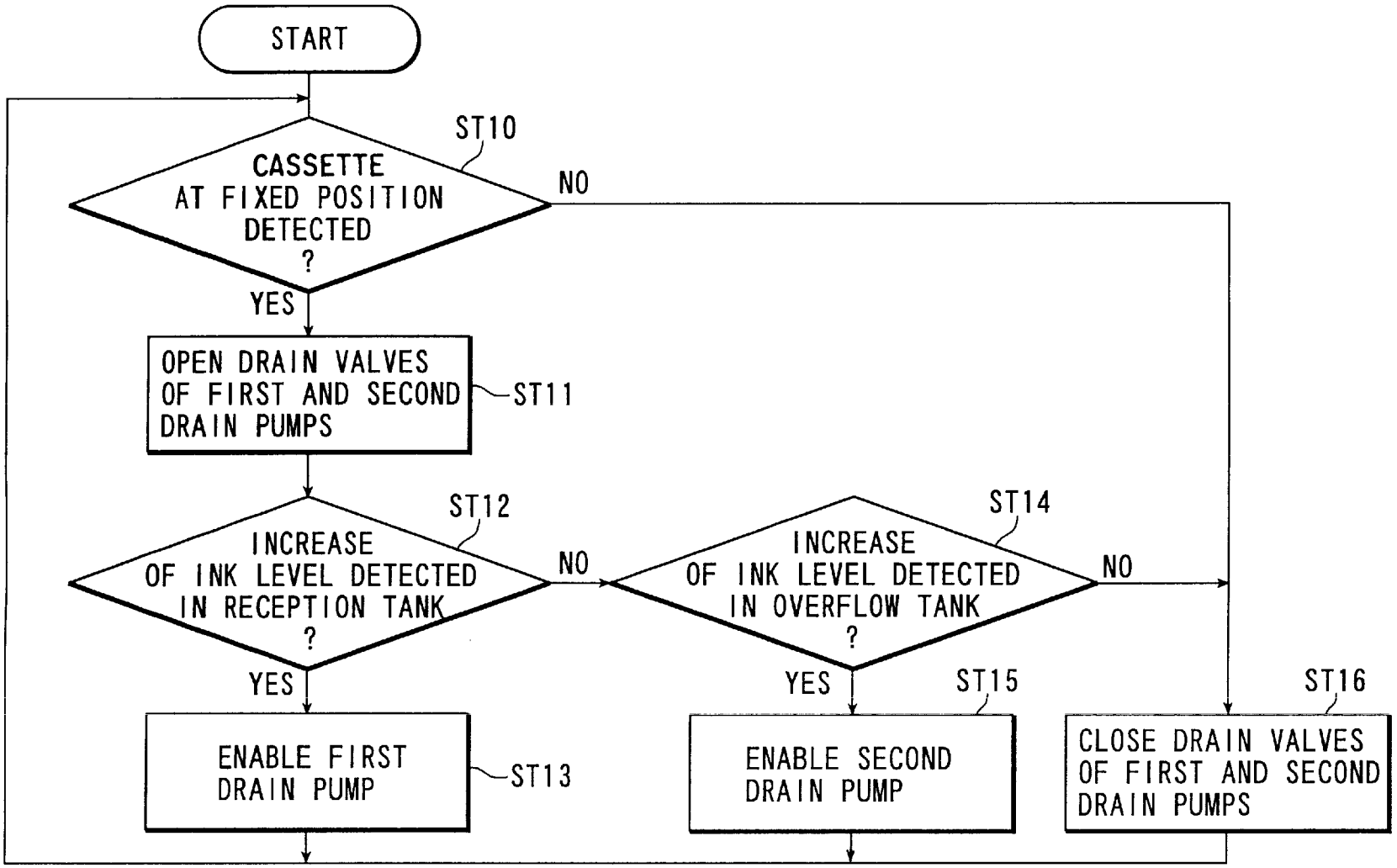
FIG. 9 is a flowchart showing the operation of the ink treatment system shown in FIG. 8.

A modification of the ink treatment system shown in FIG. 2 will be described with reference to FIGS. 8 and 9. Similar portions are indicated by the same reference numerals as those shown in FIG. 2, and detailed explanations thereof are omitted.

In this modification, components of the four ink supply units 40 are integrated into a first module, and components of the ink drain section 50 are integrated into a second module, and the first and second modules are removably installed in the ink-jet printer.

In each ink supply unit 40, one end of the ink supply tube 41 and one end of the ink return tube 47 have a cap structure in which the end is automatically opened and closed in response to attachment and detachment, so that leakage of ink can be prevented. In order to securely circulate ink via the ink chambers 22, these ends are connected to the corresponding nozzle unit 20 when the first module is installed in the ink-jet printer.

Each ink supply unit 40 includes an impact purge mechanism 27, valves 28 and 29, and a ventilation section AR. The impact purge mechanism 27 is interposed in the ink supply tube 41 located between the ink adjust section 43 and the nozzle unit 20, the valves 28 and 29 are interposed in the ink supply tube 41 near an inlet of the mechanism 27 and an outlet of the mechanism 27, respectively. The impact purge mechanism 27 is controlled by opening and closing of the valves 28 and 29 and supplies ink to the nozzle unit 20 at a pressure for cleaning. The ventilation section AR is used to vent air existing in the filter of the ink adjust section 43. The ventilation section AR includes a ventilation tube AT connected between the filter of the ink adjust section 43 and the overflow port FO of the ink tank TK and a ventilation valve AV interposed in the ventilation tube AT. The ventilation valve AV is opened in a state where the valve 28 is closed, so that air and ink in the filter are fed through the ventilation tube AT to the ink tank TK. If forcible supply of ink is required during the ventilation, the supply pump 42 is driven in a state where the ventilation valve is opened. In addition, the washing board 30 can be replaced by an ink receiving unit for simply collecting ink ejected from all the nozzles 23 of the nozzle units 20 (C, Y, M, B).

In the ink supply unit 40 described above, the supply pump 42 and the suction pump 48 are simultaneously driven to carry out a warming process of heating ink by the heater of the ink adjust section 43 while circulating the ink via the nozzle unit 20. In a case where printing or maintenance process is carried out by ejecting ink from the nozzle unit 20, the supply pump 42 is driven continuously or intermittently in a state where the suction pump 48 is not driven.

On the other hand, in the ink drain section 50, a first drain pump 57A is interposed in the waste ink tube 58 located between the separation tank 53 and the detachable waste ink tank 70, and a second drain pump 57B is interposed in the common drain tube 58' corresponding to the drain tube 58 located between the first drain pump 57A and the waste ink cassette 70. The drain tube 55 is connected between the common drain tube 58' and the separation tank 53, and the suction pump 54 is interposed in the drain tube 55 as a third drain pump. The drain pumps 57A, 57B, and 54 are of the rotary type having a valve function of setting the elastic tube into a closed state by terminating the rotation of the four pressure rollers and into an open state by rotating the pressure rollers. Therefore, the overflow tank 62 can be provided at a position lower than the position of the waste ink cassette 70 as indicated by a two-dot chain line in FIG. 8, because waste ink can be forcibly drained to the waste ink cassette 70 at an upper position. Further, the positional relationship between the ink tank TK and the overflow tank 62 can be freely determined in the vertical direction.

In a case where the first drain pump 57A and the second drain pump 57B are stopped and set in a closed state, a flow of ink from the separation tank 53 to the waste ink cassette 70 and a flow of ink from the overflow tank 62 to the waste ink cassette 70 are interrupted. When the drain pump 57A is driven, ink is forcibly drained from the separation tank 53 to the waste ink cassette 70. When the drain pump 57B is driven, ink is forcibly drained from the overflow tank 62 to the waste ink cassette 70. Since waste ink is collected in the airtight waste ink cassette 70, ink contamination can be completely prevented. This waste ink cassette 70 can be replaced while printing is performed. Further, the third drain pump 54 forcibly drains the mist of waste ink contained in the air gas to the waste ink cassette 70. Therefore, the mist can be prevented from being diffused in the ink-jet printer.

In the case where the first drain pump 57A and the second drain pump 57B are constituted by a single pump, this pump is commonly used at the printing time and at the non-printing time. Therefore, it is possible to moderate restriction in the inner design layout of the printer and to reduce the manufacturing cost.

In the ink drain section 50, it is checked by the sensor 79 whether the waste ink cassette 70 is set at a fixed position in step ST10. When the waste ink cassette 70 is set at the fixed position, the drain valves of the first drain pump 57A and the second drain pump 57B are opened in step ST11. Then, in step ST12, it is checked by using a level sensor (not shown) whether the ink level has exceeded a predetermined height in the separation tank 53. When the ink level has exceeded the predetermined height, the first drain pump 57A is driven in step ST13 to forcibly drain ink from the separation tank 53 to the waste ink cassette 70. If the ink level has not exceeded the predetermined height, it is checked in step ST14 by using a level sensor (not shown) whether the ink level has exceeded a predetermined height in the overflow tank 62. When the ink level has exceeded the predetermined height, the second drain pump 57B is driven in step ST 15 to forcibly drain ink from the overflow tank 62 to the waste ink cassette 70. Further, in a case where the waste ink cassette 70 is not set at the fixed position and a case where the ink level has not exceeded the predetermined height in the overflow tank 62, the valves of the first drain pump 57A and the second drain pump 57B are closed. The third drain pump 54 is driven together with the drain pumps 57A and 57B in steps ST13 and ST15 to forcibly drains the mist of waste ink contained in the air gas existing in the separation tank 53 to the waste ink cassette 70.

According to the modification described above, the components of the four ink supply units 40 are integrated into the first module, and the components of the ink drain section 50 are integrated into the second module, and the first and second modules are removably installed in the ink-jet printer. In this case, the structure of the ink-jet printer is simplified, so that an ink-jet printer of low costs and a small size can be achieved. Further, when a malfunction occurs in the ink supply units 40 or the ink drain section 50, the factor causing the malfunction can be investigated more easily in comparison with a case where layouts of the components of the ink supply units 40 and ink drain section 50 are independently determined. Use of the ink-jet printer can be restarted by only replacement of the module.

The waste ink cassette 70 is used to collect not only waste ink obtained in the maintenance process, but also overflow ink obtained in the printing process. The overflow ink is drained to the waste ink cassette 70 on condition that the waste ink cassette 70 is set to the fixed position. Therefore, neighboring components can be securely prevented from being smudged by the overflow ink.

The overflow tank 62 is interposed in a tube connecting the waste ink cassette 70 and the ink tank TK to temporarily store the overflow ink. Therefore, even if draining of the overflow ink is not permitted due to absence or improper attachment of the waste ink cassette 70, spilling of the overflow ink can be securely prevented.

Since the second drain pump 57B has a valve function, a natural flow of the overflow ink toward the waste ink cassette 70 can be prevented in the closed state. In addition, states of enabling and disabling a flow of ink can be quickly changeable.

The mist of waste ink contained in the air gas is forcibly drained into the waste ink cassette 70 through the drain tube 55. Therefore, neighboring components can be prevented from being smudged by the mist. Further, the third drain pump 54 forcibly suction and drains the mist into the waste ink cassette 70. Accordingly, neighboring components can be more securely prevented from being smudged by the mist.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet printer comprising:

a print medium carrier for carrying a print medium;

a print head disposed above said print medium carrier, said print head printing an image by ejecting ink onto the print medium;

an ink receiving unit facing said print head at a non-printing time, said ink receiving unit receiving ink ejected from said print head for cleaning; and an ink collecting section for collecting ink from the ink receiving unit;

wherein said ink collecting section includes a blade member for wiping ink which remains on the ink receiving unit and which has not been collected after ejection of the ink; and wherein said blade member has a first blade which moves on said ink receiving unit to guide the ink which remains on the ink receiving unit to a drain hole formed at a specified portion of said ink receiving unit.

2. The ink-jet printer according to claim 1, wherein said blade member further comprises a second blade which moves together with said first blade to wipe out objects adhered to an end surface of said print head.

3. The ink-jet printer according to claim 1, wherein said ink collecting section further comprises a detachable ink collection container and a waste ink drain section for causing ink to be drained from said drain hole to said ink collection container.

4. The ink-jet printer according to claim 3, wherein said waste ink drain section further comprises a drain tube connected between the drain hole of said ink receiving unit and said ink collection container and a waste ink tank for temporarily storing ink to be drained through said drain tube.

5. The ink-jet printer according to claim 4, wherein said waste ink drain section further comprises a first pump disposed in said drain tube and interposed between said waste ink tank and said ink collection container to drain ink from said waste ink tank.

6. The ink-jet printer according to claim 5, wherein said waste ink drain section further comprises a container holder for holding said ink collection container and a sensor for sensing a ready state that said ink collection container is attached to said container holder, and said first pump serves as a value interrupting a flow of ink and is driven in the ready state sensed by said sensor to permit the flow of ink.

7. The ink-jet printer according to claim 5, wherein said waste ink drain section further comprises a second pump coupled to said waste ink tank, for suctioning ink from said ink receiving unit.

8. The ink-jet printer according to claim 7, wherein said second pump is operated when said first pump is idle.

9. The ink-jet printer according to claim 7, wherein said waste ink drain section further comprises a drain tube for draining the mist of ink contained in the air present within said waste ink tank to said ink collection container through said second pump.

10. The ink-jet printer according to claim 9, wherein said waste ink drain section further comprises a container holder for holding said ink collection container and a sensor for sensing a ready state that said ink collection container is attached to said container holder, and each of said first and second pumps serves as a valve interrupting a flow of ink and is driven in the ready state sensed by said sensor to permit the flow of ink.

11. he ink-jet printer according to claim 9, further comprising an ink supply unit having an ink supply tank for storing and supplying the ink from said ink supply tank to said print head;

wherein said ink collecting section further comprises an overflow ink drain section for causing ink overflow from said ink supply tank to be provided to said ink collection container; and wherein said overflow ink drain section includes an overflow tube coupled between said ink supply tank and said ink collection container, an overflow tank for temporarily storing ink to be drained through said overflow tube, and a third pump interposed in said overflow tube between said overflow tank and said ink collection container to drain ink from said overflow tank.

12. The ink-jet printer according to claim 11, wherein said waste ink drain section further comprises a container holder for holding said ink collection container and a sensor for sensing a ready state that said ink collection container is attached to said container holder, and each of said first, second and third pumps serves as a valve interrupting a flow of ink and is driven in the ready state sensed by said sensor to permit the flow of ink.

13. The ink-jet printer according to claim 5, further comprising an ink supply unit having an ink supply tank for storing and supplying the ink from said ink supply tank to said print head;

wherein said ink collecting section further comprises an overflow ink drain section for causing ink overflow from said ink supply tank to be provided to said ink collection container; and wherein said overflow ink drain section includes an overflow tube coupled between said ink supply tank and said ink collection container, an overflow tank for temporarily storing ink to be drained through said overflow tube, and a second pump interposed in said overflow tube between said overflow tank and said ink collection container to drain ink from said overflow tank.

14. The ink-jet printer according to claim 13, wherein said waste ink drain section further comprises a container holder for holding said ink collection container and a sensor for sensing a ready state that said ink collection container is attached to said container holder, and each of said first and second pumps serves as a valve interrupting a flow of ink and is driven in the ready state sensed by said sensor to permit the flow of ink.

15. The ink-jet printer according to claim 14, wherein said first and second pumps comprise a single pumping system.

16. The ink-jet printer according to claim 3, further comprising an ink supply unit having an ink supply tank for storing and supplying the ink from said ink supply tank to said print head; and wherein said ink collecting section further comprises an overflow ink drain section for causing ink overflow from said supply ink tank to be provided to said ink collection container.

17. The ink-jet printer according to claim 16, wherein said ink supply unit further comprises a liquid surface stabilizer for causing ink to overflow when an ink liquid surface in said supply ink tank exceeds a predetermined height.

18. The ink-jet printer according to claim 16, wherein said ink supply unit comprises a detachable first module, and wherein said waste ink drain section and said overflow ink drain section comprise a detachable second module.

19. The ink-jet printer according to claim 3, further comprising an ink supply unit having an ink supply tank for storing and supplying the ink from said ink supply tank to said print head;

wherein said ink collecting section further comprises an overflow ink drain section for causing ink overflow from said ink supply tank to be provided to said ink collection container; and wherein said overflow ink drain section includes an overflow tube coupled between said ink supply tank and said ink collection container, an overflow tank for temporarily storing ink to be drained through said overflow tube, and a pump interposed in said overflow tube between said overflow tank and said ink collection container to drain ink from said overflow tank, said overflow tank being disposed lower than that of said ink collection container.

* * * * *

UNITED STATES PATENT AND TRADEMARK OFFICE

CERTIFICATE OF CORRECTION

PATENT NO. : 6,312,094 B1
DATED : November 6, 2001
INVENTOR(S) : Takuro Ito et al.

It is certified that error appears in the above-identified patent and that said Letters Patent is hereby corrected as shown below:

Title page,
Item [56], References Cited,
Under U.S. PATENT DOCUMENTS, insert -- 4,819,012 4/1989 Kiyohara et al. --,
Under FOREIGN PATENT DOCUMENTS, insert -- 0,605,121 A2 7/1994 EPO --,
Insert -- OTHER PUBLICATIONS
Patent Abstracts of Japan, Vol. 096, No. 010,
October 31, 1996 & JP 08 150722 A (Canon Inc.),
June 11, 1996.

Patent Abstracts of Japan, Vol. 016, No. 529
(M-1332), October 29, 1992 & JP 04 197638 A
(Canon Inc.), July 17, 1992. --.

Signed and Sealed this

Twenty-seventh Day of August, 2002

*Attest:*

*Attesting Officer*

JAMES E. ROGAN
*Director of the United States Patent and Trademark Office*